US005884679A

United States Patent [19]

Hansen et al.

[11] Patent Number: 5,884,679

[45] Date of Patent: Mar. 23, 1999

[54] SOLUTION DISPENSING BOTTLE ASSEMBLY

[75] Inventors: Eric J. Hansen, Ada; Wesley D. Mersman; Robert C. Coon, both of Holland, all of Mich.

[73] Assignee: Bissell Inc., Grand Rapids, Mich.

[21] Appl. No.: 646,617

[22] Filed: May 8, 1996

Related U.S. Application Data

[60] Provisional application No. 60/002,215, Aug. 11, 1995.

[51] Int. Cl. [6] ..... B65D 47/00

[52] U.S. Cl. ..... 141/386; 141/285; 141/346; 215/43; 215/309; 220/254

[58] Field of Search ..... 141/18, 285, 346, 141/383, 386; 222/400.7, 325; 15/320; 220/254; 215/43, 45, 309, 317

[56] References Cited

U.S. PATENT DOCUMENTS

| | | | |
|---|---|---|---|
| 3,064,844 | 11/1962 | Hoffmann | 215/45 |
| 3,247,992 | 4/1966 | Exton | 215/43 X |
| 3,402,843 | 9/1968 | Campbell | 215/386 |
| 3,407,954 | 10/1968 | Millis | 215/43 X |
| 4,230,230 | 10/1980 | Mumford | 215/317 X |
| 4,558,484 | 12/1985 | Groth | 15/320 |
| 4,676,287 | 6/1987 | Fitzwater | 141/285 |
| 4,883,192 | 11/1989 | Krugman | 220/711 |
| 5,025,942 | 6/1991 | Lucas | 215/317 X |
| 5,029,719 | 7/1991 | Solomon | 215/309 X |
| 5,065,908 | 11/1991 | Mengeu | 222/480 |
| 5,247,972 | 9/1993 | Tetreault | 141/383 X |
| 5,299,608 | 4/1994 | Bosyj | 141/285 |
| 5,526,853 | 6/1996 | McPhee et al. | 141/386 X |
| 5,586,590 | 12/1996 | Venooker et al. | 141/386 |

*Primary Examiner*—J. Casimer Jacyna
*Attorney, Agent, or Firm*—Rader, Fishman, Grauer & McGarry

[57] ABSTRACT

A solution dispensing bottle assembly adapted for snap-locking to a water extraction cleaning machine is shown. The bottle assembly includes a bottle having a tapered neck with an adapter telescopically mounted on the tapered neck. The adapter includes a pair of flexible flanges having apertures provided thereon. In mounting the bottle assembly to a known water extraction cleaning machine, the flexible flanges receive inwardly extending lugs provided on the machine in a snap-fit interlocking manner. The bottle is quickly removed from the machine by squeezing the flexible flanges inwardly a sufficient distance to remove the opposed lugs from the flange apertures and then sliding the bottle assembly away from the lugs.

22 Claims, 3 Drawing Sheets

SOLUTION DISPENSING BOTTLE ASSEMBLY

RELATED APPLICATION INFORMATION

This application claims the benefit of U.S. provisional patent application Ser. No. 60/002,215 filed Aug. 11, 1995.

BACKGROUND OF THE INVENTION

1. Field of the Invention

This invention relates to a solution dispensing bottle assembly and, more particularly, to a bottle assembly adapted to be received in a deep cleaning or water extraction cleaning machine.

2. Description of the Related Art

Water extraction cleaning machines, sometimes called deep cleaning machines, typically require the mixing of a concentrated cleaning detergent with water to create a desired cleaning solution for application to the surface to be cleaned. The solution can either be mixed manually by the user by pouring a premeasured amount of detergent into a clean water reservoir and adding water thereto, or a bottle of detergent can be fluidly connected to mixing means provided on the extraction cleaning machine. Examples of water extraction cleaning machines incorporating detergent bottles and means for mixing the liquid contained therein with water from a clean solution reservoir include U.S. Pat. No. 4,676,287 issued Jun. 30, 1987 to Fitzwater and U.S. Pat. No. 5,299,608 issued Apr. 5, 1994 to Bosyj. Both of these patents show means incorporated on both the water extraction cleaning machine and the bottle for securing the bottle to the machine while fluid is conveyed from the bottle to the mixing means in the machine.

The water extraction cleaning machine of U.S. Pat. No. 4,676,287 comprises a docking port provided on the machine wherein the port is adapted to receive the neck of a bottle assembly. A pair of inwardly extending studs or projections are provided on the interior side wall of the port. The projections cooperate with a pair of helically-shaped grooves formed on the exterior surface of a rotating collar of the bottle assembly. The collar is rotated relative to the bottle and projection for drawing the bottle into the operative position and securing the bottle to the machine.

SUMMARY OF THE INVENTION

The solution dispensing bottle assembly according to the invention comprises a bottle assembly for use in a cleaning machine of the type disclosed in U.S. Pat. No. 4,676,287. The bottle assembly according to the invention comprises a hollow container having a neck formed on one end thereof. An adapter is mounted on the exterior surface of the neck and has at least one resilient flange integrally formed therein for resilient deflection with respect to the container. An aperture is formed in the flange. The aperture is dimensioned to snugly receive an inwardly extending lug provided on the water extraction cleaning machine. The lug is received in the flange aperture when the container is secured in the operative position to the water extraction cleaning machine. The container is removed from the machine by manually deforming the flange relative to the container and the machine a sufficient distance so that the lug is no longer received in the flange aperture.

Preferably, two resilient flanges are provided on the adapter, the flanges are cantilevered and formed by a U-shaped groove provided in the adapter.

In an alternative embodiment, each resilient flange further includes a depression provided on the exterior surface thereof extending from the terminal end of the flange to the lug aperture. The depression is adapted to slidably receive the lug as the container is slid into and removed from the water extraction cleaning machine.

In still another embodiment, the adapter is telescopically received around the neck. A depression is formed on either the container or the adapter and a projection is formed on the other of the container and adapter. The depression and projection are complementary to one another so that the adapter will be retained on the container when the projection is received in the depression. Preferably, the depression is provided on the container and the projection is provided on the adapter.

BRIEF DESCRIPTION OF THE DRAWINGS

The invention will now be described with reference to the drawings in which.

DETAILED DESCRIPTION OF THE PREFERRED EMBODIMENTS

Figures 1, 2:
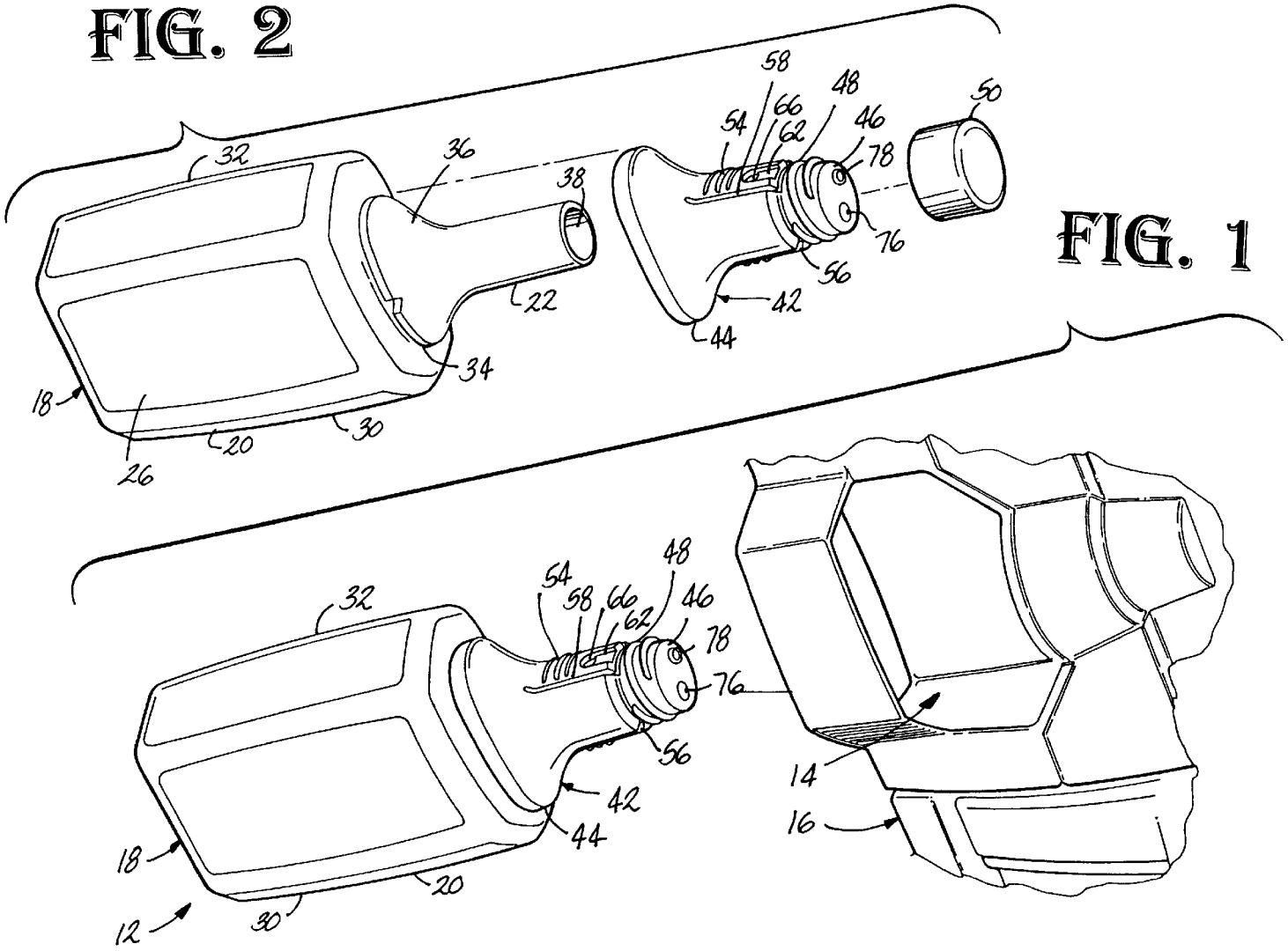
FIG. 1 is an exploded view of a dispensing bottle assembly according to the invention and a portion of the water extraction cleaning machine.
FIG. 2 is an exploded, perspective view of the bottle assembly shown in FIG. 1.

Referring now to FIGS. 1–5, the solution dispensing bottle assembly 12 according to the invention is adapted to be received in a suitable docking port 14 provided in a water extraction cleaning machine 16. The solution dispensing bottle assembly 12 according to the invention is intended to be used in the water extraction cleaning machine of the type described in U.S. Pat. No. 4,676,287 which is incorporated herein by reference. Although the bottle assembly 12 according to the invention is intended to supply concentrated cleaning detergent to the water extraction cleaning machine 16, the bottle assembly can be adapted for conducting any liquid to a machine or support structure having opposed lugs similar to that seen in U.S. Pat. No. 4,676,287.

The bottle assembly according to the invention comprises a bottle 18, preferably blow molded, which comprises a body portion 20, a tapered neck 22 extending from one end of the body portion 20 and a bottom wall 24 provided opposite the tapered neck. Preferably, the body portion 20 is generally trapezoidal in cross section wherein the front wall 26 and rear wall 28 are substantially planar and substantially parallel to one another and the front wall is wider than the rear wall 30, 32. The side walls interconnecting the front and rear walls 26, 28 are somewhat arcuate. A groove 34 is provided in the bottle 18 at the junction between the body portion 20 and the tapered neck 22. Preferably, the groove 34 extends around the entire perimeter of the bottle 18.

The tapered neck 22 comprises a broad base 36 provided at one end thereof and a circular opening 38 provided at the other end thereof. The body of the neck 22 tapers upwardly from the base 36 to the circular opening 38.

An adapter 42 is adapted to be secured to the tapered neck 22 of the bottle 18. The adapter 42 comprises a broad base 44 which is substantially complementary to the base 36 of the tapered neck 22 and a substantially circular end wall 46 provided at the other end thereof. The body of the adapter 42 intermediate the base 44 and the end wall 46 tapers upwardly from the base to the end wall. The exterior surface of the adapter 42 immediately adjacent the end wall 46 has circular threads 48 provided thereon which are adapted to receive a cap 50 for enclosing the end wall 46. A pair of flexible cantilevered flanges 52, 54 are formed in the body of the adapter 42 by a pair of U-shaped grooves 56, 58. The grooves are oriented so that the attached base of the flanges 52, 54 is adjacent the broad base 44 of the adapter 42, and the bight portion of the U-shaped groove is adjacent the threaded end of the adapter 42. Each of the flanges 52, 54 has a longitudinally extending recess or depression formed on the exterior surface thereof extending from the end of the flange adjacent the bight portion of the U-shaped groove and terminating at circular apertures 64, 66 provided in the body of the flanges 52, 54. A plurality of ribs 68, 70 can be formed on the outside surface of the flanges 52, 54 in order to provide a grippable surface for a user when installing or removing the bottle assembly 12.

The adapter 42 telescopically surrounds the neck 22 and is secured thereto through the cooperation of an inwardly extending projection, preferably a rib 72 provided on the inside of the adapter and a groove 34 provided on the exterior surface of the container. The rib 72 is preferably complementary to the groove and dimensioned so that the rib is snap-fit into the groove. Even though the cooperating rib 72 and groove 34 are preferably formed on the bottle 18 and adapter 42, respectively, this arrangement can be easily reversed.

Figure 3:
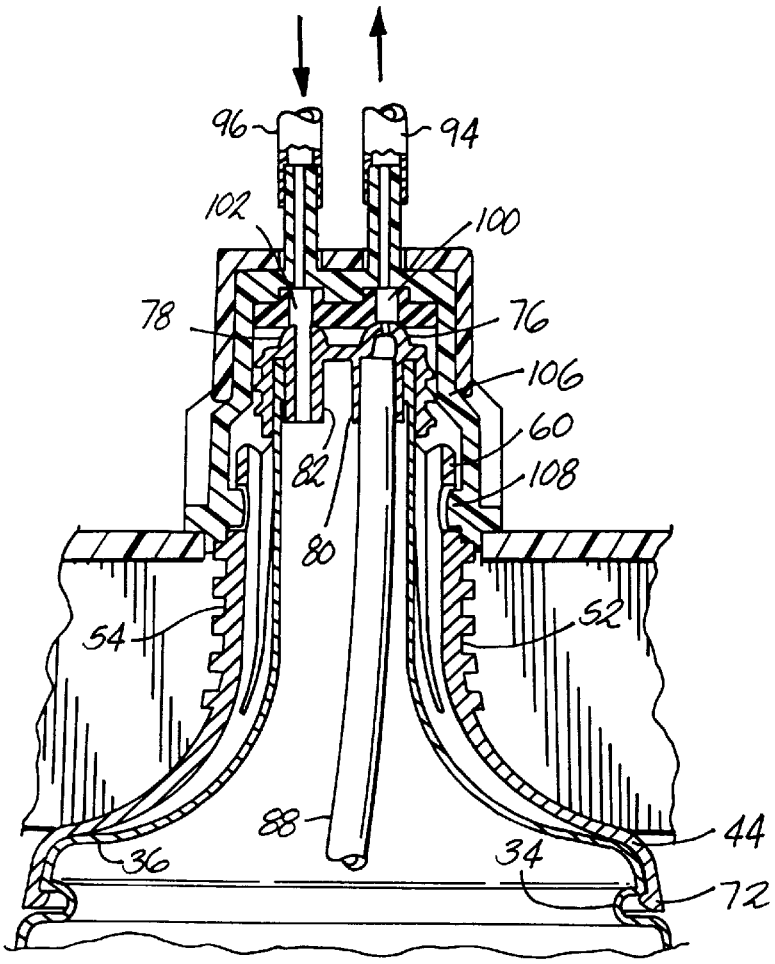
FIG. 3 is a partial, sectional view of the neck of the bottle assembly as received in the water extraction cleaning machine.
Figure 4:
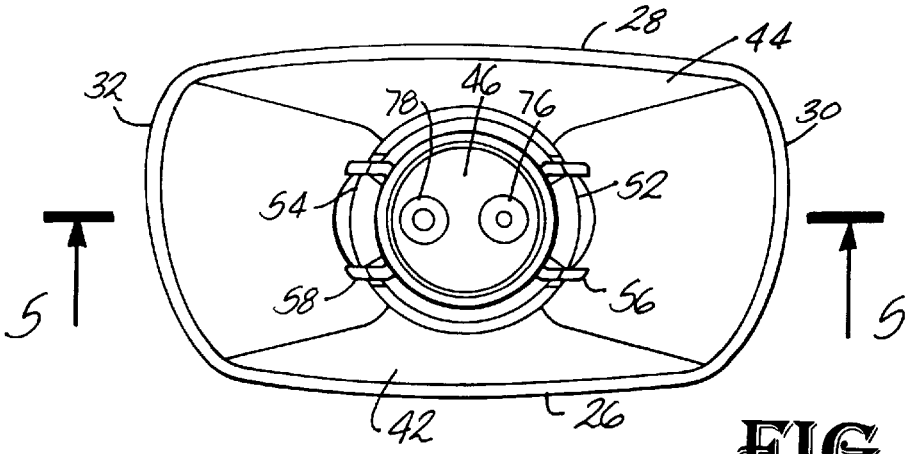
FIG. 4 is a top, plan view of the bottle assembly.
Figure 5:
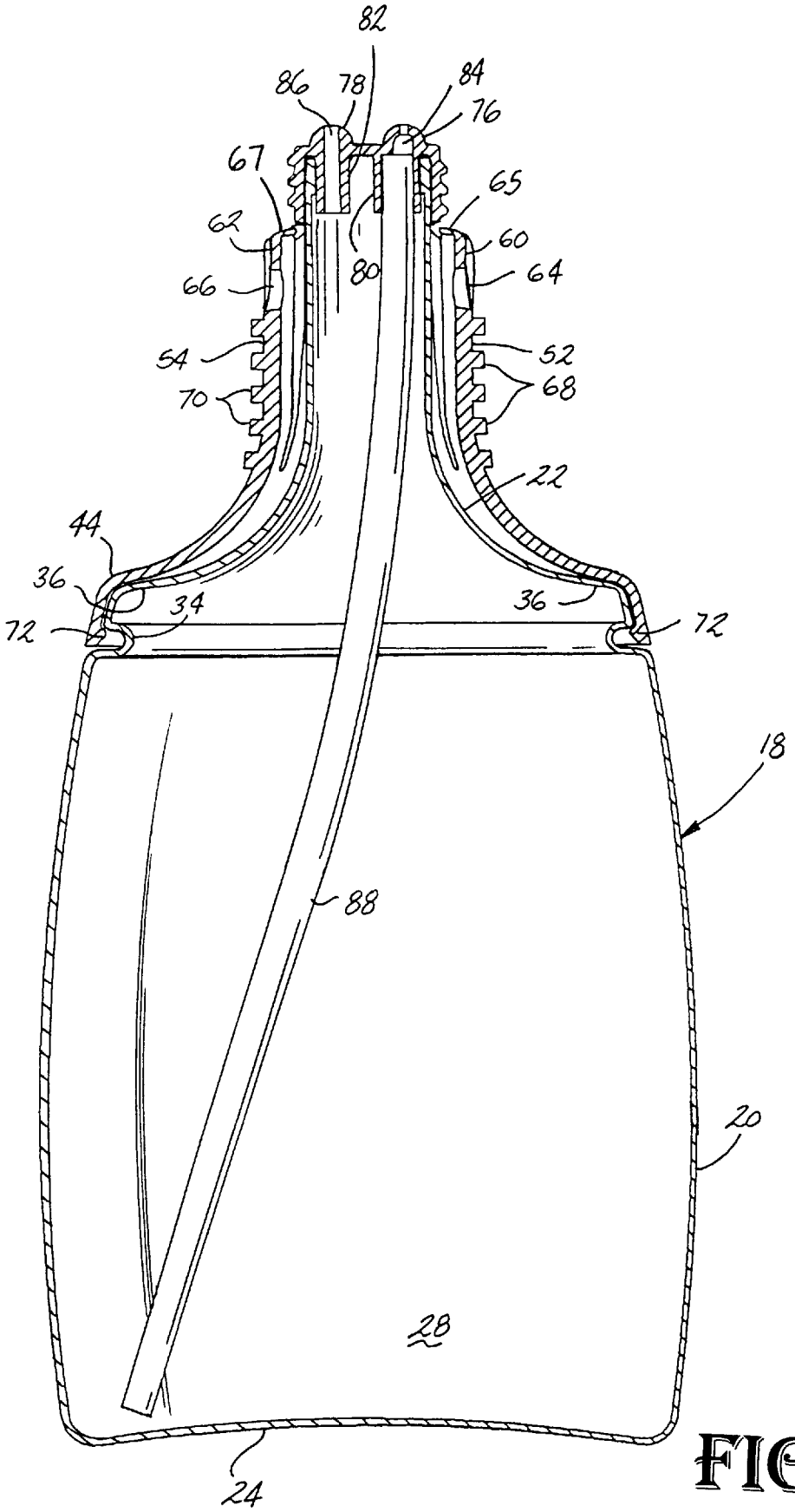
FIG. 5 is a sectional view of the bottle assembly taken along lines 5—5 of FIG. 4.

As seen in FIGS. 3 and 4, the end wall 46 of the adapter has a pair of nipples 76, 78 provided on the exterior surface thereof. A pair of bosses 80, 82 are formed on the interior of the adapter end wall 46 opposite the nipples 76, 78. Fluid flow conduits 84, 86 extend through the nipples 76, 78 and bosses 80, 82, respectively. One of the bosses 80 is dimensioned to receive one end of a straw 88 which is received inside the bottle 18 when the bottle and adapter 42 are assembled. The straw extends to the bottom of the bottle 18.

As seen in FIG. 3, the nipples 76, 78 and corresponding flow conduits 84, 86 are adapted to be fluidly connected to a liquid supply conduit 94 and an air supply conduit 96 provided on the water extraction cleaning machine 16. Preferably, an elastomeric member 98 is provided in the base of the port 14 of the cleaning machine 16. Apertures 100, 102 are formed in the elastomeric member for conducting air and detergent therethrough. When the bottle assembly 12 is properly received in the recess 14 of the cleaning machine 16, the straw 88 and flow conduit 86 are fluidly connected to the liquid supply conduit 94 of the machine, and the flow conduit 84 is fluidly connected to the air supply conduit 96.

In order to maintain an effective, substantially air- and fluid-tight seal between the flow conduits 84, 86 of the bottle assembly and the supply conduits 94, 96 of the extraction cleaning machine, means are incorporated to retain the nipples 76, 78 snugly against the elastomeric member 98 and corresponding apertures 100, 102. As described in further detail in U.S. Pat. No. 4,676,287, the water extraction cleaning machine 16 comprises a support member 106 having a pair of inwardly directed lugs 108, 110 provided on the inside surface thereof. The lugs 108, 110 cooperate with the deformable flanges 52, 54 to secure the bottle assembly 12 within the machine recess 14 and maintain the substantially fluid- and air-tight seal between the bottle assembly and the machine.

When the adapter 42 is mounted on the bottle 18, the flexible flanges 52, 54 are spaced from the side walls of the tapered neck 22 a sufficient distance to permit inward deflection of the flanges 52, 54 relative to the neck 22. The bottle assembly 12 is inserted into the recess 14 and secured thereto by sliding the adapter 42 and tapered neck 22 of the bottle into the recess 14 a sufficient distance until the lugs 108, 110 contact the terminal ends 65, 67 of the flanges. As sliding insertion of the bottle assembly continues, the lugs 108, 110 are received in the surface recesses 60, 62 of the flanges 52, 54 and slide therein. The lugs 108, 110 slide along the recesses until the lugs 108, 110 overlie the apertures 64, 66 of the flanges 52, 54. The natural spring bias of the flanges 52, 54 will force the flanges outwardly relative to the lugs so that the lugs 108, 110 will be received in the apertures 64, 66 of the flanges, thereby locking the bottle assembly to the support member 106 of the cleaning machine 16. The flanges 52, 54 and apertures 64, 66 are positioned so that the lugs 108, 110 will be received in the apertures 64, 66 when the nipples 76, 78 snugly contact the elastomeric member 98 of the bottle recess 14.

The bottle assembly 12 is quickly and easily removed from the bottle recess 14 by grasping the flanges 52, 54 and squeezing them inwardly a sufficient distance until the lugs 108, 110 are no longer received in the apertures 64, 66. Then, the user can slideably withdraw the bottle assembly 12 from the bottle recess 14. As the bottle is withdrawn therefrom, the lugs 108, 110 slide along the surface recesses 60, 62 provided on the deformable flanges 52, 54. Once the bottle assembly 12 has been removed from the recess 14, the user can quickly and easily insert a replacement bottle assembly, if necessary.

Preferably, the cap 50 and adapter 42 are formed pursuant to a conventional injection molding process from polypropylene. The bottle 18 is preferably formed pursuant to a conventional blow molding process from high density polyethylene and the straw 88 is formed pursuant to a conventional extrusion process from polyethylene.

The snap-interlocking bottle assembly according to the invention is an improvement over the known bottle interlocking mechanism because it is easier to manufacture and assemble the bottle. The interlocking mechanism is an effective alternative to the rotating collar member as described in U.S. Pat. No. 4,676,287.

reasonable variation and modification are possible within the spirit of the foregoing specification and drawings without departing from the scope of the invention.

The embodiments for which an exclusive property or privilege is claimed are defined as follows:

1. A container assembly for selectively mounting to a water extraction cleaning machine, the machine having a port for receiving the container assembly and at least one inwardly extending lug provided in the port, the container comprising:

a hollow container having an exterior surface and a pair of opposed ends, one of said ends being closed and the other end forming a neck with an opening therein; and an adapter mounted on an exterior surface of the neck and having an exterior wall, the adapter having at least one resilient flange integrally formed in the exterior wall for resilient deflection with respect to the container and the at least one resilient flange being inwardly deflectable and having an aperture formed therein, the aperture being dimensioned to snugly receive the at least one inwardly extending lug of the water extraction cleaning machine;

whereby the at least one lug is received in the at least one flange aperture when the container is secured in the operative position to the water extraction cleaning machine and the container is removed from the machine by manually deforming the at least one flange relative to the container and the machine a sufficient distance so that the at least one lug is no longer received in the at least one flange aperture.

2. A container assembly according to claim 1 wherein two resilient flanges are provided on the adapter for receiving two inwardly extending lugs provided in the port.

3. A container assembly according to claim 2 wherein the resilient flanges are cantilevered and are each formed by a U-shaped groove formed in the adapter.

4. A container assembly according to claim 3 wherein each groove comprises a pair of opposed side portions and a bight portion, the bight portion being positioned adjacent the open end of the container when the adapter is mounted on the container.

5. A container assembly according to claim 4 wherein each resilient flange further comprises an exterior surface, a terminal end immediately adjacent the bight portion of the groove and a depression provided on an exterior surface of the flange, the depression extending from the terminal end to the aperture and dimensioned to slidably receive one of the lugs.

6. A container assembly according to claim 2 wherein the adapter further comprises an end wall adapted to close the open end of the container when the adapter is mounted thereon, the end wall having at least one aperture provided therein for the flow of fluid therethrough.

7. A container assembly according to claim 6 wherein two fluid flow apertures are formed in the end wall.

8. A container assembly according to claim 2 and further comprising a plurality of raised ribs provided on an exterior surface of the flanges.

9. A container assembly according to claim 2 wherein the adapter is telescopically received around at least a portion of the container and further comprising a depression formed on one of the container and adapter and a projection formed on the other of the container and adapter, said depression and projection being complementary to one another so that the adapter will be retained on the container when the projection is received in the depression.

10. A container assembly according to claim 9 wherein the depression is provided on the container and comprises a groove circumscribing the container.

11. A container assembly according to claim 10 wherein the projection is provided on the adapter and comprises an inwardly extending rib.

12. A container assembly according to claim 2 wherein the apertures are spaced a substantially equal distance from the container other end.

13. A container assembly for selectively mounting to a water extraction cleaning machine, the machine having a port for receiving the container assembly and a pair of inwardly extending lugs provided in the port, the container comprising:

a hollow container having a body portion, a tapered neck extending from the body portion, and a pair of opposed ends, one open end provided on the neck and one closed end provided on the body portion; and an adapter telescopically received around at least a portion of the neck of the container, the adapter having a pair of opposed ends and a body portion with an exterior wall intermediate the ends, a pair of resilient flanges integrally formed in the adapter in the exterior wall, a portion of each flange being resiliently movable inwardly with respect to the container and having an aperture formed therein, the aperture being dimensioned to snugly receive one of the inwardly extending lugs of the water extraction cleaning machine;

whereby each lug is received in one of the flange apertures when the container assembly is secured in the operative position to the water extraction cleaning machine and the container assembly is removed from the machine by manually deforming the flanges relative to the container and the machine a sufficient distance so that the lugs are no longer received in the flange apertures.

14. A container assembly according to claim 13 wherein one of the ends of the adapter is open and the other end is closed by an end wall.

15. A container assembly according to claim 13 and further comprising a depression formed on one of the container and adapter and a projection formed on the other of the container and adapter, said depression and projection being complementary to one another so that the adapter will be retained on the container when the projection is received in the depression.

16. A container assembly according to claim 13 wherein the deformable flanges are each formed by a U-shaped groove formed in the adapter.

17. A container assembly according to claim 16 wherein each groove comprises a pair of opposed side portions and a bight portion, the bight portion being adapted to be positioned adjacent the open end of the container when the adapter is mounted on the container.

18. A container assembly according to claim 17 wherein each flexible flange further comprises an exterior surface, a terminal end immediately adjacent the bight portion of the groove, and a depression on the exterior surface of the flange, the depression extending from the terminal end to the aperture and dimensioned to slidably receive a lug while flexing the flange inwardly.

19. A container assembly according to claim 13 wherein the adapter further comprises an end wall adapted to close the open end of the container when the adapter is telescopically received thereon, the end wall having at least one aperture provided therein for the flow of fluid therethrough.

20. A container assembly according to claim 19 wherein two fluid flow apertures are formed in the end wall.

21. A container assembly according to claim 13 and further comprising a plurality of raised ribs provided on an exterior surface of the flanges.

22. A container assembly according to claim 13 wherein the flanges are spaced a substantially equal distance from the container other end.

* * * * *